US006950798B1

(12) United States Patent
Beutnagel et al.

(10) Patent No.: US 6,950,798 B1
(45) Date of Patent: Sep. 27, 2005

(54) EMPLOYING SPEECH MODELS IN CONCATENATIVE SPEECH SYNTHESIS

(75) Inventors: Mark Charles Beutnagel, Mendham, NJ (US); David A. Kapilow, Berkely Heights, NJ (US); Ioannis G. Stylianou, Crete (GR); Ann K. Syrdal, Morristown, NJ (US)

(73) Assignee: AT&T Corp., New York, NY (US)

( * ) Notice: Subject to any disclaimer, the term of this patent is extended or adjusted under 35 U.S.C. 154(b) by 692 days.

(21) Appl. No.: 10/090,065

(22) Filed: Mar. 2, 2002

Related U.S. Application Data

(60) Provisional application No. 60/283,586, filed on Apr. 13, 2001.

(51) Int. Cl.[7] ..... G10L 13/08; G10L 13/00; G10L 13/06; H04R 29/00

(52) U.S. Cl. ..... 704/260; 704/258; 704/267; 704/268; 381/51

(58) Field of Search ..... 704/258, 267, 704/268, 260; 381/51

(56) References Cited

U.S. PATENT DOCUMENTS

| | | | | |
|---|---|---|---|---|
| 5,327,498 | A * | 7/1994 | Hamon | 704/268 |
| 5,327,521 | A * | 7/1994 | Savic et al. | 704/272 |
| 5,987,413 | A * | 11/1999 | Dutoit et al. | 704/267 |
| 6,330,538 | B1 * | 12/2001 | Breen | 704/260 |
| 6,366,883 | B1 * | 4/2002 | Campbell et al. | 704/260 |
| 6,470,316 | B1 * | 10/2002 | Chihara | 704/267 |
| 6,665,641 | B1 * | 12/2003 | Coorman et al. | 704/260 |
| 6,845,358 | B2 * | 1/2005 | Kibre et al. | 704/260 |
| 2001/0047259 | A1 * | 11/2001 | Okutani et al. | 704/260 |
| 2002/0051955 | A1 * | 5/2002 | Okutani et al. | 434/185 |
| 2002/0128841 | A1 * | 9/2002 | Kibre et al. | 704/260 |

OTHER PUBLICATIONS

Stylianou, Y.; Cappe, O.; A System for Voice conversation Based on Probabilistic Classification And a Harmonic Plus Noise Model; Proceedings of the IEEE ICASSP '98; vol.: 1; pp.: 281-284; □ □ May 12-15, 1998.□ □.*

* cited by examiner

*Primary Examiner*—Tālivaldis Ivars Šmits
*Assistant Examiner*—Myriam Plerre
(74) *Attorney, Agent, or Firm*—Henry T. Brendzel

(57) ABSTRACT

A text-to-speech synthesizer employs database that includes units. For each unit there is a collection of unit selection parameters and a plurality of frames. Each frame has a set of model parameters derived from a base speech frame, and a speech frame synthesized from the frame's model parameters. A text to be synthesized is converted to a sequence of desired unit features sets, and for each such set the database is perused to retrieve a best-matching unit. An assessment is made whether modifications to the frames are needed, because of discontinuities in the model parameters at unit boundaries, or because of differences between the desired and selected unit features. When modifications are necessary, the model parameters of frames that need to be altered are modified, and new frames are synthesized from the modified model parameters and concatenated to the output. Otherwise, the speech frames previously stored in the database are retrieved and concatenated to the output.

41 Claims, 3 Drawing Sheets

EMPLOYING SPEECH MODELS IN CONCATENATIVE SPEECH SYNTHESIS

RELATED APPLICATION

This invention claims priority from provisional application No. 60,283,586, titled Fast Harmonic Synthesis for a Concatenative Speech Synthesis System, which was filed on Apr. 13, 2001. This provisional application is hereby incorporated by reference.

BACKGROUND OF THE INVENTION

This invention relates to speech synthesis.

In the context of speech synthesis that is based on Concatenation of acoustic units, speech signals may be encoded by speech models. These models are required if one wishes to ensure that the concatenation of selected acoustic units results in a smooth transition from one acoustic unit to the next. Discontinuities in the prosody (e.g., pitch period, energy), in the formant frequencies and in their bandwidths, and in phase (inter-frame incoherence) would result in unnatural-sounding speech.

In, "Time-Domain and Frequency-Domain Techniques for Prosodic Modifications of Speech," chapter 15 in "Speech Coding and Synthesis," edited by W. B. Kleijn and K. K. Paliwal, Elsevier Science, 1995 pp, 519–555, E. Moulines et al, describe an approach which they call Time-Domain Pitch Synchronous Overlap Add (TD-PSOLA) that allows time-scale and pitch-scale modifications of speech from the time domain signal. In analysis, pitch marks are synchronously set on the pitch onset times, to create preselected, synchronized, segments of speech. On synthesis, the preselected segments of speech are weighted by a windowing function and recombined with overlap-and-add operations. Time scaling is achieved by selectively repeating or deleting speech segments, while pitch scaling is achieved by stretching the length and output spacing of the speech segments.

A similar approach is described in U.S. Pat. No. 5,327,498, issued Jul. 5, 1994.

Because TD-PSOLA does not model the speech signal in any explicit way, it is referred to as "null" model. Although it is very easy to modify the prosody of acoustic units with TD-PSOLA, its non-parametric structure makes their concatenation a difficult task.

T. Dutoit et al, in "Text-to-Speech Synthesis Based on a MBE Re-synthesis of the Segments Database," *Speech Communication*, vol. 13, pp. 435–440, 1993, tried to overcome concatenation problems in the time domain by re-synthesizing voiced parts of the speech database with constant phase and constant pitch. During synthesis, speech frames are linearly smoothed between pitch periods at unit boundaries.

Sinusoidal model approaches have also been proposed also for synthesis. These approaches perform concatenation by making use of an estimator of glottal closure instants. Alas, it is a process that is not always successful. In order to assure inter-frame coherence, a minimum phase hypothesis has been used sometimes.

LPC-based methods, such as impulse driven LPC and Residual Excited LP (RELP), have been also proposed for speech synthesis. In LPC-based methods, modifications of the LP residuals have to be coupled with appropriate modifications of the vocal tract filter. If the interaction of the excitation signal and the vocal tract filter is not taken into account, the modified speech signal is degraded. This interaction seems to play a more dominant role in speakers with high pitch (e.g., female and child voice). However, these kinds of interactions are not fully understood yet and, perhaps consequently, LPC-based methods do not produce good quality speech for female and child speakers. An improvement of the synthesis quality in the context of LPC can be achieved with careful modification of the residual signal, and such a method has been proposed by Edgington et al in "Overview of current text-to-speech Techniques: Part II—Prosody and Speech Generation," *Speech Technology for Telecommunications*, Ch 7, pp. 181–210, Chapman and Hall, 1998. The technique is based on pitch-synchronous re-sampling of the residual signal during the glottal open phase (a phase of the glottal cycle which is perceptually less important) while the characteristics of the residual signal near the glottal closure instants are retained.

Most of the previously reported speech models and concatenation methods have been proposed in the context of diphone-based concatenative speech synthesis. Recently, an approach for synthesizing speech by concatenating non-uniform units selected from large speech databases has been proposed by numerous artisans. The aim of these proposals is to reduce errors in modeling of the speech signal and to reduce degradations from prosodic modifications using signal-processing techniques. One such proposal is presented by Campbell, in "CHATR: A High-Definition Speech Re-Sequencing System," *Proc. 3rd ASA/ASJ Joint Meeting*, (Hawaii), pp. 1223–1228, 1996. He describes a system that uses the natural variation of the acoustic units from a large speech database to reproduce the desired prosodic characteristics in the synthesized speech. This requires, of course, a process for selecting the appropriate acoustic unit, but a variety of methods for optimum selection of units have been proposed. See, for instance, Hunt et al, "Unit Selection in a Concatenative Speech Synthesis System Using Larger Speech Database," *Proc. IEEE int. Conf. Acoust., Speech, Signal Processing*, pp. 373–376, 1996, where a target cost and a concatenation cost is attributed in each candidate unit, where the target cost is the weighted sum of the differences between elements such as prosody and phonetic context of the target candidate units. The concatenation cost is also determined by the weighted sum of cepstral distances at the point of concatenation and the absolute differences in log power and pitch. The total cost for a sequence of units is the sum of the target and concatenation coats. The optimum unit selection is performed with a Viterbi search. Even though a large speech database is used, it is still possible that a unit (or a sequence of units) with a large cost has to be selected because a better unit (e.g., with prosody closer to the target values) is not present in the database. This results in a degradation of the output synthetic speech. Moreover, searching large speech databases can slow down the speech synthesis process.

An improvement of CHATR has been proposed by Campbell in "Processing a Speech Corpus for CHATR Synthesis," *Proc. of ICSP'97*, pp. 183–186, 1997 by using sub-phonemic waveform labeling with syllabic indexing (reducing, thus, the size of the waveform inventory in the database). Still, a problem exists when prosodic variations need to be performed in order to achieve natural-sounding speech.

SUMMARY OF THE INVENTION

An advance in the art is realized with an apparatus and a method that creates a text-to-speech synthesizer. The text-to-speech synthesizer employs two databases: a synthesis database and a unit selection database.

The synthesis database divides the previously obtained corpus of base speech into small segments called frames. For each frame the synthesis database contains a set of modeling parameters that are derived by analyzing the corpus of base speech frames. Additionally, a speech frame is synthesized from the model parameters of each such base speech frame. Each entry in the synthesis database thus includes the model parameters of the base frame, and the associated speech frame that was synthesized from the model parameters.

The unit selection database also divides the previously obtained corpus of base speech into larger segments called units and stores those units. The base speech corresponding to each unit is analyzed to derive a set of characteristic acoustic features, called unit features. These unit features sets aid in the selection of units that match a desired feature set.

A text to be synthesized is converted to a sequence of desired unit features sets, and for each such desired unit features set the unit selection database is perused to select a unit that best matches the desired unit features. This generates a sequence of selected units. Associated with each store unit there is a sequence of frames that correspond to the selected unit.

When the frames in the selected unit closely match the desired features, modifications to the frames are not necessary. In this case, the frames previously created from the model parameters and stored in the synthesis database are used to generate the speech waveform.

Typically, however, discontinuities at the unit boundaries, or the lack of a unit in the database that has all the desired unit features, require changes to the frame model parameters. If changes to the model parameters are indicated, the model parameters are modified, new frames are generated from the modified model parameters, and the new frames are used to generate the speech waveform.

DETAILED DESCRIPTION

In Beutnagel et al, "The AT&T Next-Gen TTS System," 137$^{th}$ *Meeting of the Acoustical Society of America,* 1999, http://www.research.att.com/projects/tts, two of the inventors herein contributed to the speech synthesis art by describing a text-to-speech synthesis system where one of the possible "back-ends" is the Harmonic plus Noise Model (HNM). The Harmonic plus Noise Model has provides high-quality copy synthesis and prosodic modifications, as demonstrated in Stylianou et al, "High-Quality Speech Modification Based on a Harmonic+Noise Model," *Proc. EUROSPEECH*, pp. 451–454, 1995. See also Y. Stylianou "Applying the Harmonic Plus Noise Model in Concatenative Speech Synthesis," *IEEE Transactions on Speech and Audio Processing*, Col. 9, No. 1. January 2001, pp. 21–29. The HNM is the model of choice for our embodiment of this invention, but it should be realized that other models might be found that work as well.

Illustratively, the synthesis method of this invention employs two databases: a synthesis database and a unit selection database. The synthesis database contains frames of time-domain signals and associated modeling parameters. The unit selection database contains sets of unit features. These databases are created from a large corpus of recorded speech in accordance with a method such as the methods depicted in FIG. 1 and FIG. 2.

Figure 1:
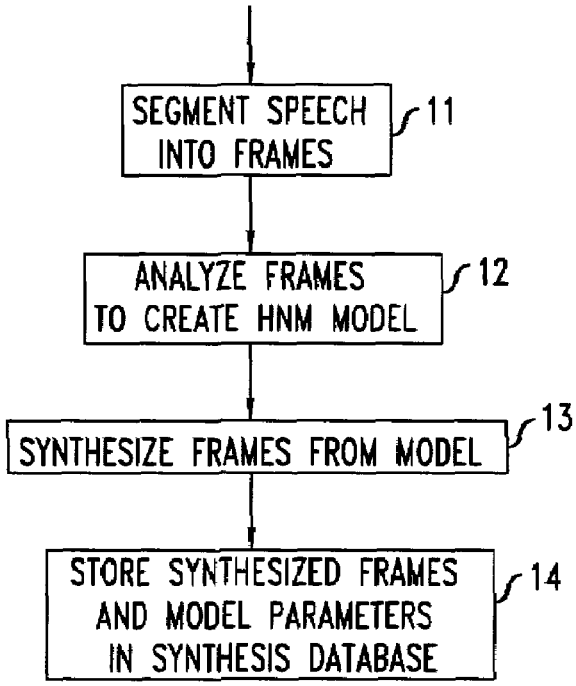
FIG. 1 presents a flow diagram of the speech analysis for a synthesis database creation process in accord with the principles disclosed herein.

The FIG. 1 method shows how the synthesis database is created. In step 11 the base speech is segmented into analysis frames. For voiced speech, the analysis frames are overlapping and are on the order of two pitch periods each in duration. For unvoiced speech, a fixed length frame is used. In step 12, the base speech is analyzed and the HNM model parameters for each frame are determined. In step 13 the model created in step 12 is used to generate a synthetic frame of speech. The generated synthetic frames are on the order of one pitch period of speech. In step 14, the model parameters created by step 11 and the synthesized speech created by step 13 are stored in the synthesis database for future use. Thus, associated with each speech frame that was created by step 11 there is an HNM model parameters set (step 12) and a synthesized frame (step 13) in the synthesis database.

Figure 2:
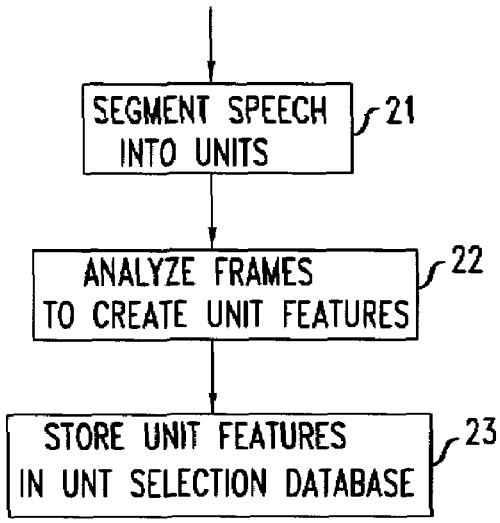
FIG. 2 presents a flow diagram of the speech analysis for a unit selection database creation process in accord with the principles disclosed herein.

The FIG. 2 method shows how the unit selection database is created. Step 21 divides the speech corpus into relatively short speech units, each of which may be half-phone in duration, or somewhat larger, and it consists of many pitch periods. The frames that a unit corresponds to are identified. These units are then analyzed in step 22 to develop unit features—i.e., the features that a speech synthesizer will use to determine whether a particular speech unit meets the synthesizer's needs. In step 23, the unit features for each unit are stored in the unit selection database, together with the IDs of the first and last frame of the unit. Obviously, it is advantageous to store in the unit selection database as many of such (different) units as possible, for example, in the thousands, in order to increase the likelihood that the selected unit will have unit features that match closely the desired unit features. Of course the number of stored units is not an essential feature of the invention, but within some reasonable storage and database retrieval limits, the more the better.

It is noted that both FIG. 1 and FIG. 2 are conventional processes, that the order of execution of the methods in FIG. 1 and FIG. 2 are unimportant, that the use of the HNM model is not a requirement of this invention, and that the created data can be stored in a single database, rather than two.

The processes shown in FIG. 1 and FIG. 2 are carried out once, prior to any "production" synthesis, and the data developed therefrom is used thereafter for synthesizing any and all desired speech.

Figure 3:
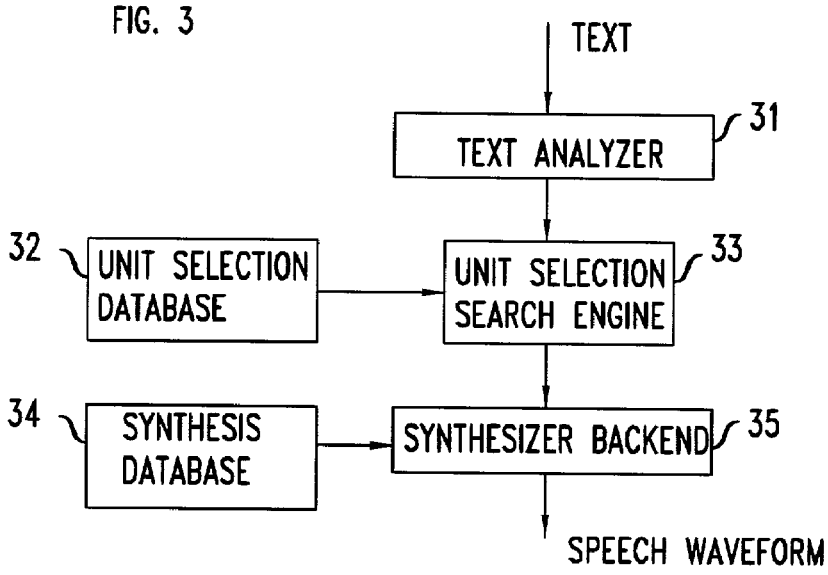
FIG. 3 presents a block diagram of a text-to-speech apparatus in accord with the principles disclosed herein.

FIG. 3 presents a block diagram of a text-to-speech apparatus for synthesizing speech that employs the databases created by the FIG. 1 and FIG. 2 processes. Element 31 is a text analyzer that carries out a conventional analysis of the input text and creates a sequence of desired unit features sequence. The desired unit features developed by element 31 are applied to element 33, which is a unit selection search engine that accesses unit selection database 32 and selects, for each desired unit features set a unit that possesses unit features that best match the desired unit features; i.e. that possesses unit features that differ from the desired unit features by the least amount. A selection leads to the retrieval from database 32 of the unit features and the frame IDs of the selected unit. The unit features of the selected unit are retrieved in order to assess the aforementioned difference and so that a conclusion can be reached regarding whether some model parameters of the frames associated with the selected unit (e.g., pitch) need to be modified.

The output of search engine 33 is, thus, a sequence of unit information packets, where a unit information packet contains the unit features selected by engine 33, and associated frame IDs. This sequence is applied to backend module 35, which employs the applied unit information packets, in a seriatim fashion, to generate the synthesized output speech waveform.

It is noted that once an entry is selected from the database, the selected synthesized speech unit could be concatenated to the previously selected synthesized speech unit, but as is well known in the art, it is sometimes advisable to smooth the transition from one speech unit to its adjacent concatenated speech unit. Moreover, the smoothing process can be (a) to modify only the tail end of the earlier considered speech unit (unit-P) to smoothly approach the currently considered speech unit (unit-C), (b) to modify only the head end of unit-C to smoothly approach unit-P, or (c) to modify both the tail end of unit-P, and the head end of unit-C.

In the discussion that follows, option (c) is chosen. The modifications that are effected in the tail end of unit-P and the head end of unit-C can be in accordance with any algorithm that a practitioner might desire. An algorithm that works quite well is a simple interpolation approach.

To illustrate, let $\omega_0^{mI}$ be the fundamental frequency of frame i contained in speech unit m. This parameter is part of the HNM parameter sets. A simple linear interpolation of the fundamental frequency at a unit boundary is realized by computing $$\Delta\omega=(\omega_0^{m+1,1}-\omega_0^{m,K})/2 \tag{1}$$

where K is the last frame in unit m, and then modifying L terminal frames of unit m in accordance with $$\tilde{\omega}_o^{m,(K-L+i)} = \omega_o^{m,(K-L+i)} + \Delta\omega\frac{i}{L},\ i = 1, 2, \ldots L, \tag{2}$$

and modifying the R initial frames of unit m+1 in accordance with $$\tilde{\omega}_o^{(m+1),i} = \omega_o^{(m+1),i} - \Delta\omega\frac{(R+1-i)}{R},\ i = 1, 2, \ldots R. \tag{3}$$

In an identical manner, the amplitudes of each of the harmonics, also parameters in the HNM model, can be interpolated, resulting in a smooth transition at concatenation points.

Figure 4:
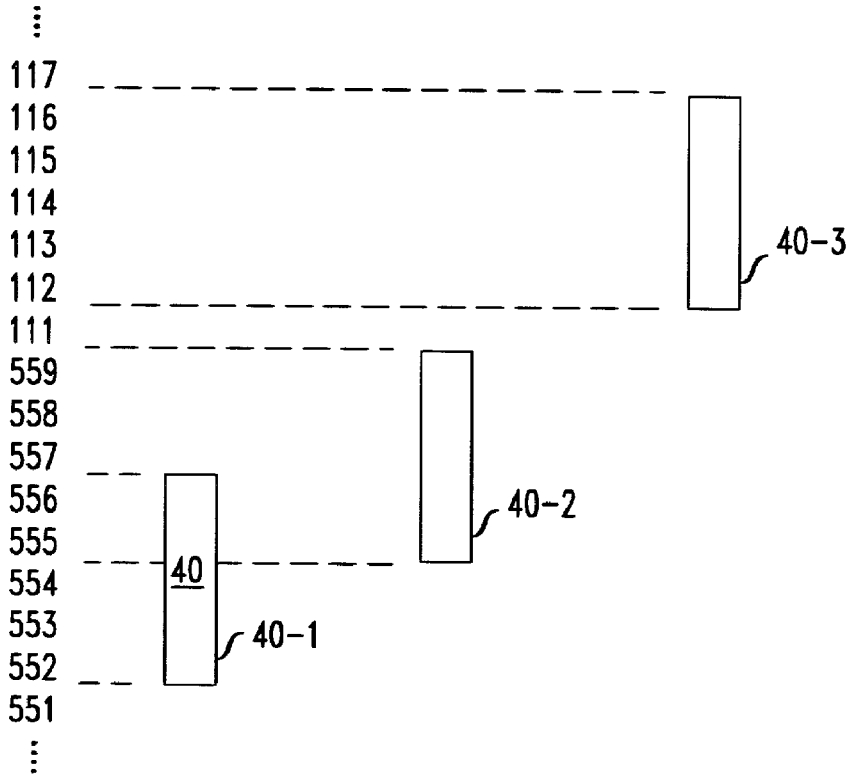
FIG. 4 illustrates three interpolation window positions.

In accordance with the above described interpolation approach, the synthesis process can operate on a window of L+R frames. Assuming, for example, that a list can be created of the successive frame IDs of a speech unit, followed by the successive frame IDs of the next speech unit, for the entire sequence of units created by element 31, one can then pass an L+1 frame window over this list, and determine whether, and the extent to which, a frame that is about to leave the window needs to be modified. The modification can then be effected, if necessary, and a time domain speech frame can be created and concatenated to the developed synthesized speech signal. This is illustrated in FIG. 4, where a 5-frame window 40 is employed (L=4), and parts of two units (m and m+1) are shown. Unit m includes a sequence of frames where the terminal end includes frames 552 through 559, and the immediately following unit m+1 includes a sequence of frames where the starting end includes frames 111 through 117. The demarcation between units m and m+1 is quite clear, since the frame IDs change by something other than +1. Position 40-1 is at a point in the sequence where frame 552 is about to exit the window, and frame 557 is about to enter the window. For sake of simplicity, it can be assumed that whatever modifications are made to frame 552, they are not the result of an effort to smooth out the transition with the previous unit (m−1). Position 40-2 is a point where frame 555 is about to exit the window and frame 111 is about to enter the window. At this point it is realized that a new unit is entering the window, and equation (1) goes into effect to calculate a new Δω value, and equation (2) goes into effect to modify frame 555 (i=1). Position 40-3 is a point where frame 112 is about to exit the window and frame 117 is about to enter the window. Frame 112 is also modified to smooth the transition between units m and m+1, but at this point, equation (3) is in effect.

While the aforementioned list of frame IDs can be created ab initio, it is not necessary to do so because it can be created on the fly, whenever the window approaches a point where there is a certain number of frame ID's left outside the window, for example, one frame ID.

Figure 5:
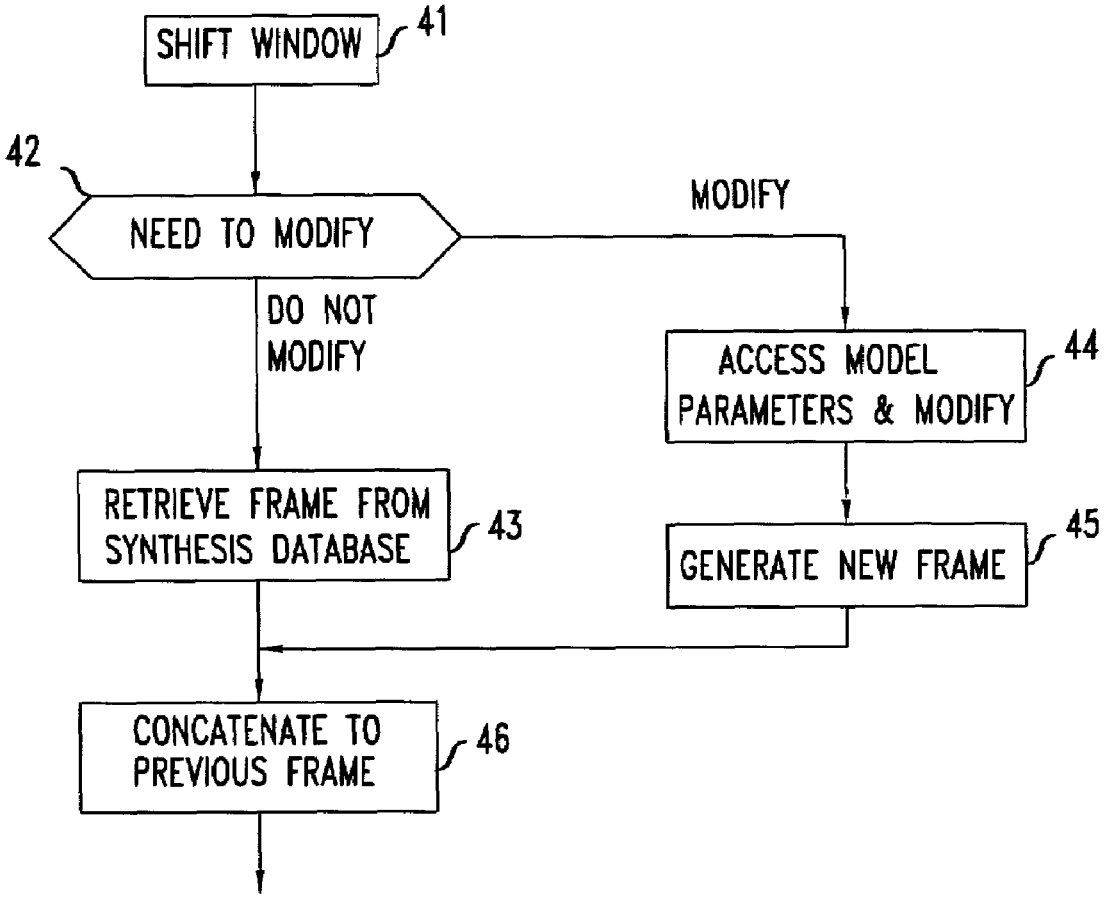
FIG. 5 presents detailed flow diagram of the synthesizer backend in accord with the principles disclosed herein.

The synthesis process carried out module 35 is depicted in FIG. 5. The depicted process assumes that a separate process appropriately triggers engine 33 to supply the sets of unit features and associated frame IDs, in accordance with the above discussion.

In step 41, the FIG. 4 window shifts causing one frame to exit the window as another frame enters the window. Step 42 ascertains whether the frame needs to be modified or not. If it does not need to be modified, control passes to step 43, which accesses database 34 and retrieves therefrom the time-domain speech frame corresponding to the frame under consideration, and passes control to step 46. Step 46 concatenates the time-domain speech frame provided by step 43 to the previous frame, and step 47 output the previous frame's time-domain signal.

It should be remembered that step 42 ascertains whether the frame needs to be modified in two phases. In phase one step 42 determines whether the units features of the selected unit match the desired unit features within a preselected value of a chosen cost function. If so, no phase one modifications are needed. Otherwise, phase one modifications are needed. In phase two, a determination of modifications needed to a frame are made based on the aforementioned interpolation algorithm. Advantageously, phase one modifications are made prior to determining whether phase two modifications are needed.

When step 42 determines that the frame under consideration belongs to a unit whose frames need to be modified, or that the frame under consideration is one needs to be modified pursuant to the aforementioned interpolation algorithm, control passes to step 45, which accesses the HNM parameters of the frame under consideration, modifies the parameters as necessary, and passes control to step 45. Step 45 generates a time-domain speech frame from the modified HNM parameters, on the order of one period in duration, for voices frames, and of a duration commensurate to the duration of unvoiced frames in the database, for unvoiced frames, and applies the generated time-domain speech frame to step 46. In step 46, each applied voiced frame is first extended to two pitch periods, which is easily accomplished with a copy since the frame is periodic. The frame is then multiplied by an appropriate filtering window, and overlapped-and-added to the previously generated frame. The output of step 46 is the synthesized output speech.

It is noted that, individually, each of the steps that is employed in the FIG. 2 process involves a conventional process that is well known to artisans in the field of speech synthesis. That is, processes are known for segmenting speech into units and developing unit features set for each unit (steps 21, 22). Processes are also known for segmenting speech into frames and developing model parameters for each frame (steps 11, 12). Further, processes are known for selecting items based on a measure of "goodness" of the selection (interaction of elements 33 and 32). Still further, processes are known for modifying HNM parameters and synthesizing time-domain speech frames from HNM parameters (steps 44, 45), and for concatenating speech segments (steps 46).

The above disclosure presents one embodiment for synthesizing speech from text, but it should be realized that other applications can benefit from the principles disclosed herein, and that other embodiments are possible without departing from the spirit and scope of this invention. For example, as was indicated above, a model other than HNM may be employed. Also, a system can be constructed that does not require a text input followed by a text to speech unit features converter. Further, artisans who are skilled in the art would easily realize that the embodiment disclosed in connection with FIG. 3 diagram could be implemented in a single stored program processor.

We claim:

1. An arrangement for creating synthesized speech from an applied sequence of desired speech unit features parameter sets, D-SUF(i), i=2,3, . . . , comprising:

a database that contains a plurality of sets, E(k), k=1,2, . . . ,K, where K is an integer, each set E(k) including a plurality of associated frames in sequence, each of said frames being represented by a collection of model feature parameters, and T-D data representing a time-domain speech signal corresponding to said frame, and a collection of unit selection parameters which characterize the model feature parameters of the speech frames in the set E(k);

a database search engine that, for each applied D-SUF(i), selects from said database a set E(i) having a collection of unit selection parameters that match best said D-SUF (i), and said plurality of frames that are associated with said E(i), thus creating a sequence of frames;

an evaluator that determines, based on assessment of information obtained from said database and pertaining to said E(i), whether modifications are needed to frames of said E(i);

a modification and synthesis module that, when said evaluator concludes that modifications to frames are needed, modifies the collection of model parameters of those frames that need modification, and generates, for each frame having a modified collection of model parameters, T-D data corresponding to said frame; and a combiner that concatenates T-D data of successive frames in said sequence of frames, by employing, for each concatenated frame, the T-D data generated for said concatenated frame by said modification and synthesis module, if such T-D data was generated, or T-D data retrieved for said concatenated frame from said database.

2. The arrangement of claim 1 where said assessment by said evaluator is made with a comparison between collection of model parameters of a frame at a head end of said E(i) and collection of model parameter of a frame at a tail end of a previously selected set, E(i-1).

3. The arrangement of claim 2 where said comparison determines whether said model parameters of said frame at head end of said E(i) differ from said model parameters of said frame at a tail end of said E(i-1) by more than a preselected amount.

4. The arrangement of claim 3 where said comparison is based on fundamental frequency of said frame at head end of said E(i) and fundamental frequency of said frame at a tail end of said E(i-1).

5. The arrangement of claim 2 where said modification and synthesis module modifies, when said evaluator determines that modifications to frames are needed, collections of model parameters of a first chosen number of frames that are at a head region of said E(i), and collections of model parameters of a second chosen number of frames that are at a tail region of said E(i-1).

6. The arrangement of claim 2 where said modification and synthesis unit modifies said collections of model parameters of said first chosen number of frames that are at a head region of said E(i), and collectios of model parameters of said second chosen number of frames that are at a tail region of said E(i-1) in accordance with an interpolation algorithm.

7. The arrangement of claim 6 where said interpolation algorithm interpolates fundamental frequency parameter of the modified collections of model parameters.

8. The arrangement of claim 6 where said interpolation algorithm interpolates fundamental frequency parameter and amplitude parameters of the modified collections of model parameters.

9. The arrangement of claim 1 said assessment by said evaluator is made with a comparison between unit selection parameters of E(i) and said D-SUF(i).

10. The arrangement of claim 9 where said comparison determines where said unit selection parameters of said selected set E(i) differ from said D-SUF(i) by more than a selected threshold.

11. The arrangement of claim 9 where said modification and synthesis module modifies, when said evaluator determines that modifications to frames are needed, the collections of model parameters of frames of said E(i).

12. The arrangement of claim 1 where said assessment by said evaluator is made with a first comparison between unit selection parameters of E(i) and said D-SUF(i) and with a second comparison between collection of model parameters of a frame at a head end of said E(i) and collection of model parameter of a frame at a tail end of a previously selected set, E(i-1).

13. The arrangement of claim 12 where in said second comparison, said frame at a head end of said E(i) is considered after taking account of modifications to said collection of model parameters of said frame at the head end of E(i) pursuant to said first comparison.

14. The arrangement of claim 1 where said T-D data stored in said database represents one pitch period of speech, said T-D data generated by said modification and synthesis module represents one pitch period of speech, and said combiner concatenates T-D data of a frame by creating additional data for said frame to form an extended speech representation of associated frames, and carrying out a filtering and an overlap-and-add operations to add the T-D data and the created additional data to previously concatenated data.

15. The arrangement of claim 14 where said created additional data extends speech representation to two pitch periods of speech.

16. The arrangement of claim 1 where said T-D data stored in said database in association with a frame is data that was generated from said collection of model parameters associated with said frame.

17. The arrangement of claim 1 where said model parameters of a frame are in accordance with an Harmonic Plus Noise model of speech.

18. The arrangement of claim 1 where durations of said units are related to sounds of said speech segments rather than being preselected at a uniform duration.

19. The arrangement of claim 1 where said model parameters of a frame are obtained from analysis of overlapping speech frames that are on the order of two pitch periods each for voiced speech.

20. The arrangement of claim 1 further comprising a text-to-speech units converter for developing said D-SUF(i), i=2,3, . . .

21. The arrangement of claim 1 where said database search engine, evaluator, modification and synthesis module, and combiner are software modules executing on a stored program processor.

22. A method for creating synthesized speech from an applied sequence of desired speech unit features parameter sets, D-SUF(i), i=2,3, . . . , comprising the steps pfi:

for each of said D-SUF(i), selecting from a database information of an entry E(i) the E(i) having a set of speech unit characterization parameters that best match said D-SUF(i), which entry also includes a plurality of frames represented by a corresponding plurality of model parameter sets, and a corresponding plurality of time domain speech frames, said information including at least said plurality of model parameter sets, thereby resulting in a sequence of model parameter sets, corresponding to which a sequence of output speech frames is to be concatenated;

determining, based on assessment of information obtained from said database and pertaining to said E(i), whether modifications are needed to said frames of said E(i);

when said evaluator concludes that modifications to frames are needed, modifying the collection of model parameters of those frames that need modification;

generating, for each frame having a modified collection of model parameters, T-D data corresponding to said frame; and concatenating T-D data of successive frames in said sequence of frames, by employing, for each concatenated frame, the T-D data generated for said step of generating, if such T-D data was generated, or T-D data retrieved for said concatenated frame from said database.

23. The method of claim 22 where said assessment by said evaluator is made with a comparison between collection of model parameters of a frame at a head end of said E(i) and collection of model parameter of a frame at a tail end of a previously selected set, E(i-1).

24. The method of claim 23 where said comparison determines whether said model parameters of said frame at head end of said E(i) differ from said model parameters of said frame at a tail end of said E(i-1) by more than a preselected amount.

25. The method of claim 24 where said comparison is based on fundamental frequency of said frame at head end of said E(i) and fundamental frequency of said frame at a tail end of said E(i-1).

26. The method of claim 23 where said modification and synthesis module modifies, when said step of determining concludes that modifications to frames are needed, collections of model parameters of a first chosen number of frames that are at a head region of said E(i), and collections of model parameters of a second chosen number of frames that are at a tail region of said E(i-1).

27. The method of claim 23 where said modification and synthesis unit modifies said collections of model parameters of said first chosen number of frames that are at a head region of said E(i), and collections of model parameters of said second chosen number of frames that are at a tail region of said E(i-1) in accordance with an interpolation algorithm.

28. The method of claim 27 where said interpolation algorithm interpolates fundamental frequency parameter of the modified collections of model parameters.

29. The method of claim 27 where said interpolation algorithm interpolates fundamental frequency parameter and amplitude parameters of the modified collections of model parameters.

30. The method of claim 22 said assessment by said step of determining is made with a comparison between unit selection parameters of E(i) and said D-SUF(i).

31. The method of claim 30 where said comparison determines where said unit selection parameters of said selected set E(i) differ from said D-SUF(i) by more than a selected threshold.

32. The method of claim 30 where said step of modifying modifies, when said determining concludes that modifications to frames are needed, the collections of model parameters of frames of said E(i).

33. The method of claim 22 where said assessment is made with a first comparison between unit selection parameters of E(i) and said D-SUF(i) and with a second comparison between collection of model parameters of a frame at a head end of said E(i) and collection of model parameter of a frame at a tail end of a previously selected set, E(i-1).

34. The method of claim 33 where in said second comparison, said frame at a head end of said E(i) is considered after taking account of modifications to said collection of model parameters of said frame at the head end of E(i) pursuant to said first comparison.

35. The method of claim 22 where said T-D data stored in said database represents one pitch period of speech, said T-D data generated by said step of generating represents one pitch period of speech, and said step of concatenating concatenates T-D data of a frame by creating additional data for said frame to form an extended speech representation of associated frames, and carrying out a filtering and an overlap-and-add operations to add the T-D data and the created additional data to previously concatenated data.

36. The method of claim 35 where said created additional data extends speech representation to two pitch periods of speech.

37. The method of claim 22 where said T-D data stored in said database in association with a frame is data that was generated from said collection of model parameters associated with said frame.

38. The method of claim 22 where said model parameters of a frame are in accordance with an Harmonic Plus Noise model of speech.

39. The method of claim 22 where durations of said units are related to sounds of said speech segments rather than being preselected at a uniform duration.

40. The method of claim 22 where said model parameters of a frame are obtained from analysis of overlapping speech frames that are on the order of two pitch periods each for voiced speech.

41. The method of claim 22 further comprising a step of converting an applied text to a sequence of said D-SUF(i), i=2,3, . . .

* * * * *